US009098053B2

(12) United States Patent
Hashimoto et al.

(10) Patent No.: US 9,098,053 B2
(45) Date of Patent: Aug. 4, 2015

(54) IMAGE FORMING APPARATUS CAPABLE OF POSITIONING DRAWER RELATIVE TO MAIN FRAME

(71) Applicant: Brother Kogyo Kabushiki Kaisha, Nagoya-shi, Aichi-ken (JP)

(72) Inventors: Junichi Hashimoto, Toyohashi (JP); Makoto Souda, Nagoya (JP); Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/329,180

(22) Filed: Jul. 11, 2014

(65) Prior Publication Data

US 2014/0321881 A1 Oct. 30, 2014

Related U.S. Application Data

(63) Continuation of application No. 13/354,946, filed on Jan. 20, 2012, now Pat. No. 8,805,234.

(30) Foreign Application Priority Data

Mar. 31, 2011 (JP) ..... 2011-078434

(51) Int. Cl.
*G03G 21/16* (2006.01)

(52) U.S. Cl.
CPC ..... *G03G 21/1619* (2013.01); *G03G 21/1671* (2013.01); *G03G 2221/1654* (2013.01); *G03G 2221/1684* (2013.01)

(58) Field of Classification Search
CPC ..... G03G 21/1619; G03G 21/1671; G03G 2221/1654; G03G 2221/1684
See application file for complete search history.

(56) References Cited

U.S. PATENT DOCUMENTS 5,105,221 A * 4/1992 Takahashi et al. ..... 399/111
7,522,858 B2 4/2009 Okabe et al.

(Continued)

FOREIGN PATENT DOCUMENTS

EP 2149820 A1 2/2010
JP 2007-178657 A 7/2007

(Continued)

OTHER PUBLICATIONS

Office Action issued in Japanese Patent Application No. 2011-078434 mailed Apr. 2, 2013.

(Continued)

*Primary Examiner* — G. M. Hyder
(74) *Attorney, Agent, or Firm* — Banner & Witcoff, Ltd.

(57) ABSTRACT

An image forming apparatus includes: a main frame; a drawer; a plurality of cartridges; a contact member; and an urging member. The main frame includes a cover and a positioning portion. The cover is movable between a closed position covering the opening and an open position exposing an opening of the main frame. The drawer is movable relative to the main frame in a prescribed direction. The plurality of cartridges is detachably mounted in the drawer. The contact member is configured to contact the drawer in response to the movement of the cover to the closed position. The urging member is disposed between the cover and the contact member. The urging member is configured to urge the contact member toward the drawer in response to the movement of the cover to the closed position such that the drawer is pressed against the positioning portion.

9 Claims, 15 Drawing Sheets

(56) References Cited

U.S. PATENT DOCUMENTS

| | | | | |
|---|---|---|---|---|
| 7,769,320 | B2 | 8/2010 | Okabe et al. | |
| 8,045,883 | B2 | 10/2011 | Okabe et al. | |
| 8,805,234 | B2 * | 8/2014 | Hashimoto et al. | 399/110 |
| 2003/0068173 | A1 * | 4/2003 | Tanizaki et al. | 399/119 |
| 2004/0005168 | A1 * | 1/2004 | Baek | 399/116 |
| 2004/0165910 | A1 * | 8/2004 | Sato et al. | 399/116 |
| 2005/0191090 | A1 * | 9/2005 | Nishimura | 399/113 |
| 2007/0110473 | A1 * | 5/2007 | Kondo et al. | 399/117 |
| 2007/0147885 | A1 * | 6/2007 | Okabe et al. | 399/111 |
| 2008/0124118 | A1 * | 5/2008 | Ukai et al. | 399/110 |
| 2009/0092414 | A1 | 4/2009 | Tomatsu | |
| 2010/0067940 | A1 | 3/2010 | Ikezaki | |
| 2010/0080612 | A1 | 4/2010 | Nakashima | |
| 2010/0239308 | A1 * | 9/2010 | Kikuchi et al. | 399/110 |
| 2012/0148293 | A1 * | 6/2012 | Akutsu et al. | 399/110 |
| 2012/0148294 | A1 * | 6/2012 | Akutsu et al. | 399/110 |

FOREIGN PATENT DOCUMENTS

| | | | |
|---|---|---|---|
| JP | 2009-092859 | A | 4/2009 |
| JP | 2010-066700 | A | 3/2010 |

OTHER PUBLICATIONS

Notification of the First Office Action for Chinese Patent Application No. 201210042772.4 mailed May 12, 2014.

Oct. 16, 2013 Extended European Search Report issued in European Patent Application No. 1215663.7.

Pending U.S. Appl. No. 13/238,683, filed Sep. 21, 2011.

* cited by examiner

IMAGE FORMING APPARATUS CAPABLE OF POSITIONING DRAWER RELATIVE TO MAIN FRAME

CROSS REFERENCE TO RELATED APPLICATION

This application is a continuation of U.S. application Ser. No. 13/354,946, filed Jan. 20, 2012, which claims priority from Japanese Patent Application No. 2011-078434 filed Mar. 31, 2011. The entire contents of the above-noted applications are incorporated herein by reference.

TECHNICAL FIELD

The present invention relates to a photosensitive unit supporting a plurality of photosensitive drums and an image forming apparatus provided with the photosensitive unit.

BACKGROUND

A tandem type color printer conventionally well known in the art includes a main frame and a photosensitive unit. The photosensitive unit integrally supports a plurality of photosensitive drums and is configured to be slidably movable with respect to the main frame. More specifically, the photosensitive unit in the art includes a pair of metal plates, a positioning shaft, and a pair of resin frames. The pair of metal plates is adapted for supporting the plurality of photosensitive drums at its axial ends so that the plurality of photosensitive drums is disposed between the pair of metal plates. Each of the pair of metal plates has a front end portion (an end portion positioned downstream of another end portion in a mounting direction) formed with a notched portion. The positioning shaft extends in a leftward/rightward direction and bridges between rear end portions of the pair of metal plates. The pair of resin frames is adapted for supporting the front and rear end portions of the pair of metal plates.

The main frame is provided with a pressure member and a reference shaft extending in the leftward/rightward direction. The pressure member provided in the main frame presses the positioning shaft rearward, so that the notched portions formed in the front end portions of the pair of metal frames are brought into abutment with the reference shaft provided in the main frame. Thus, the photosensitive unit is positioned with respect to the main frame.

SUMMARY

However, with the above-described configuration, the positioning shaft needs to be provided in the photosensitive unit for positioning the photosensitive unit in the main frame. This leads to a problem of cost increases.

In view of the foregoing, it is an object of the present invention to provide a photosensitive unit and an image forming apparatus with such a photosensitive unit having structures capable of minimizing manufacturing costs and accurately positioning metal plates for supporting photosensitive drums with respect to a main frame of the image forming unit.

In order to attain the above and other objects, the present invention provides an image forming apparatus that may include: a main frame; a drawer; a plurality of cartridges; a contact member; and an urging member. The main frame may have an opening. The main frame may include a cover and a positioning portion. The cover may be configured to move between a closed position covering the opening and an open position exposing the opening. The drawer may be configured to be moved relative to the main frame in a prescribed direction. The plurality of cartridges may be configured to be detached from and mounted in the drawer. The contact member may be configured to contact the drawer in response to the movement of the cover to the closed position. The urging member may be disposed between the cover and the contact member. The urging member may be configured to urge the contact member toward the drawer in response to the movement of the cover to the closed position such that the drawer is pressed against the positioning portion.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
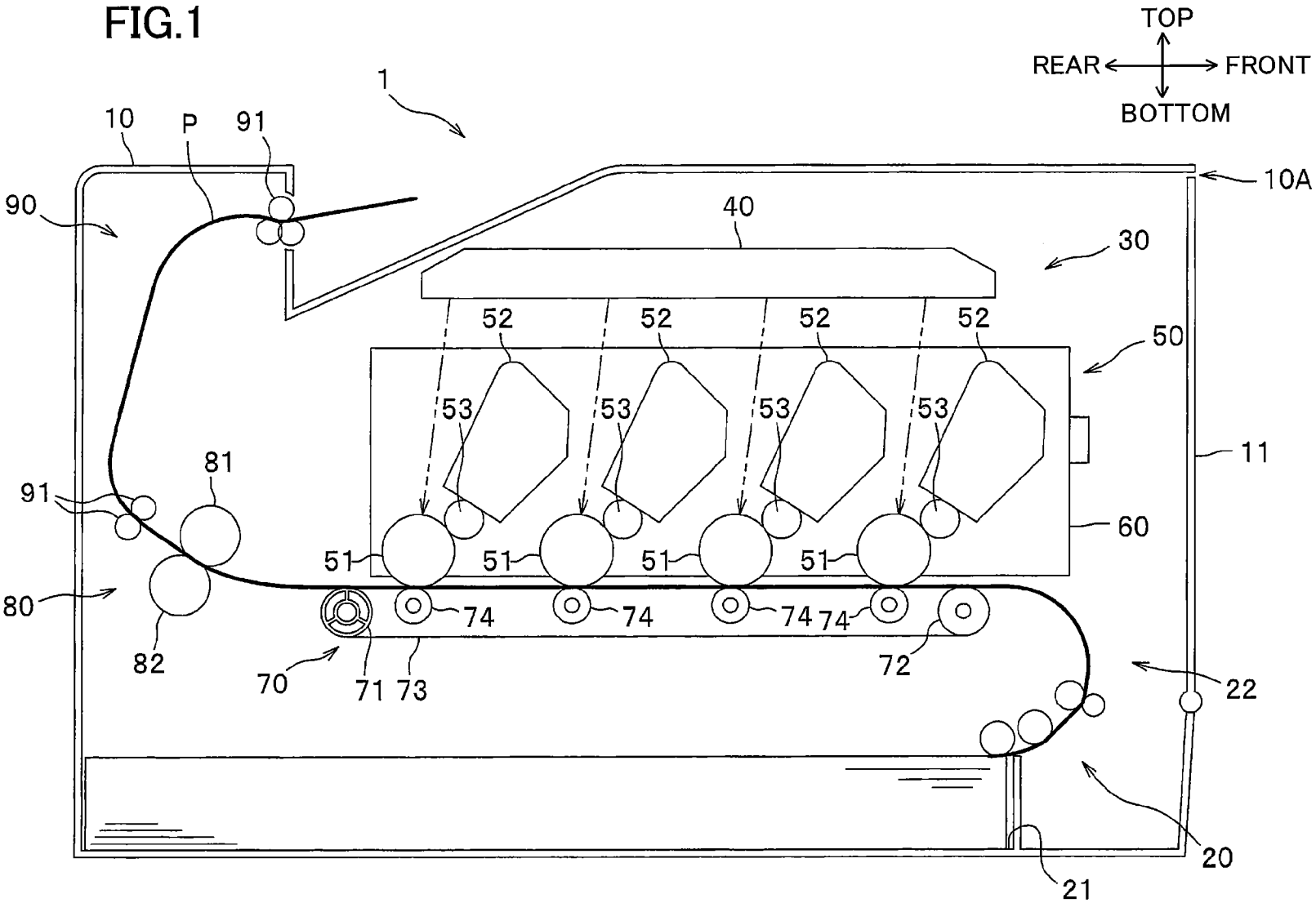
FIG. 1 is a schematic cross-sectional view of a color printer according to one embodiment of the present invention.

A color printer as an image forming apparatus according to one embodiment of the present invention will be described while referring to the accompanying drawings wherein like parts and components are designated by the same reference numerals to avoid duplicating description.

As shown in FIG. 1, the color printer 1 includes a main frame 10. Within the main frame 10, a sheet supply unit 20, an image forming unit 30, and a discharge unit 90 are provided.

The terms "upward", "downward", "upper", "lower", "above", "below", "beneath", "right", "left", "front", "rear" and the like will be used throughout the description assuming that the color printer 1 is disposed in an orientation in which it is intended to be used. Top, bottom, left, and right sides of the color printer 1 in the following description will be based on the reference point of a user viewing the color printer 1 from the front side. More specifically, in FIG. 1 a left side and a right side are a rear side and a front side, respectively, and a far side and a near side are a right side and a left side, respectively.

The main frame 10 is formed with an opening 10A. A front cover 11 is provided on a front wall of the main frame 10 over the opening 10A. The front cover 11 can be pivoted about its bottom edge between a closed position covering the opening 10A and an open position exposing the opening 10A.

The sheet supply unit 20 serves to supply a sheet P to the image forming unit 30. The sheet supply unit 20 includes a sheet supply tray 21 and a sheet conveying device 22. The sheet supply tray 21 accommodates the sheet P therein. The sheet conveying device 22 serves to convey the sheet P from the sheet supply tray 21 to the image forming unit 30.

The image forming unit 30 serves to form an image on the sheet P supplied from the sheet supply unit 20. The image forming unit 30 includes a scanner unit 40, a photosensitive unit 50, and a transfer unit 70, and a fixing unit 80.

The scanner unit 40 is disposed at an upper portion of the main frame 10. The scanner unit 40 includes a laser emission unit, a polygon mirror, a plurality of lenses, and a reflecting mirror (not shown). The laser emission unit emits laser beams onto respective photosensitive drums 51 constituting the photosensitive unit 50, as indicated by two-dotted lines in FIG. 1. Surfaces of the photosensitive drums 51 are subjected to high speed scan of the laser beams.

Figure 2:
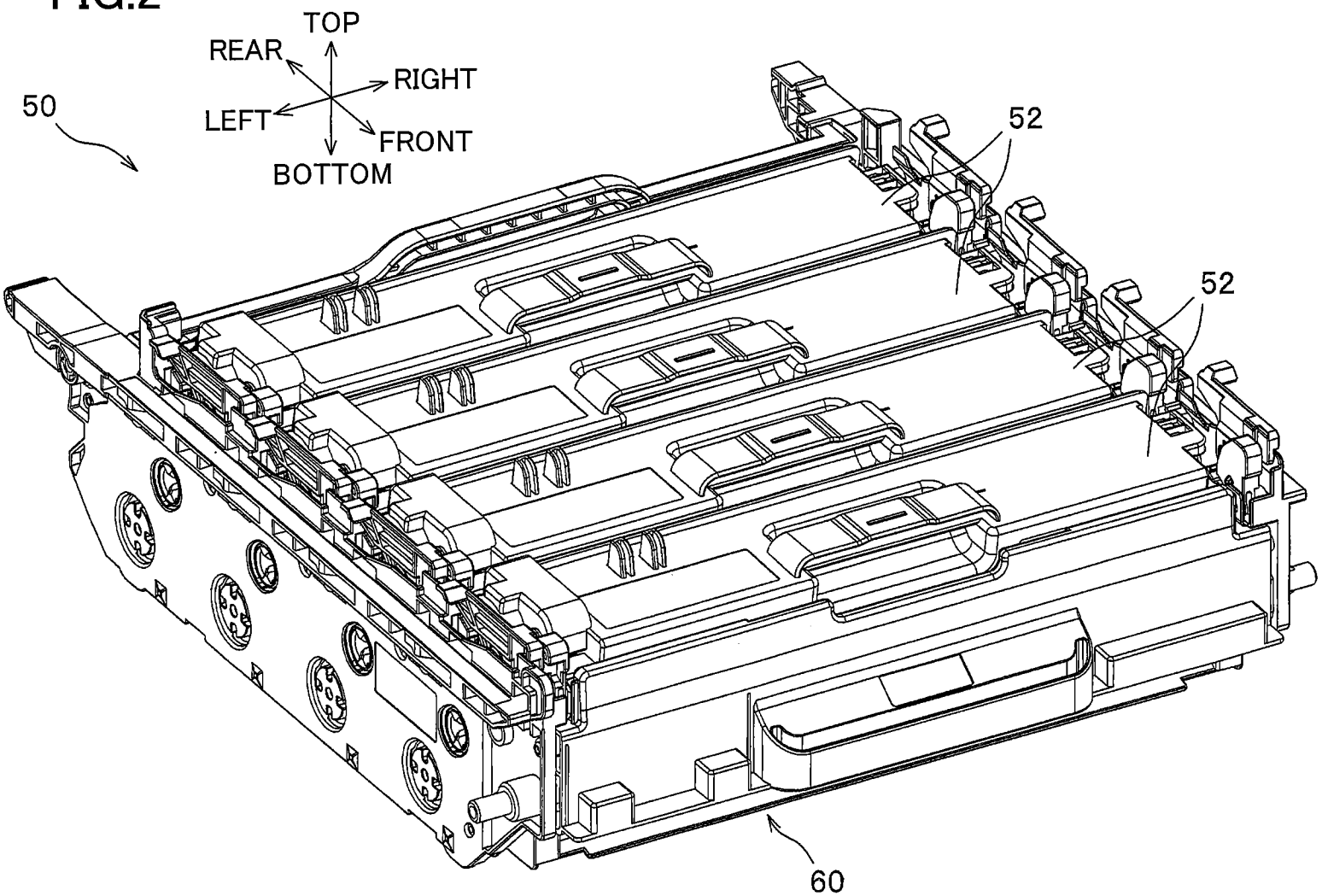
FIG. 2 is a perspective view of a photosensitive unit according to the embodiment.
Figure 3:
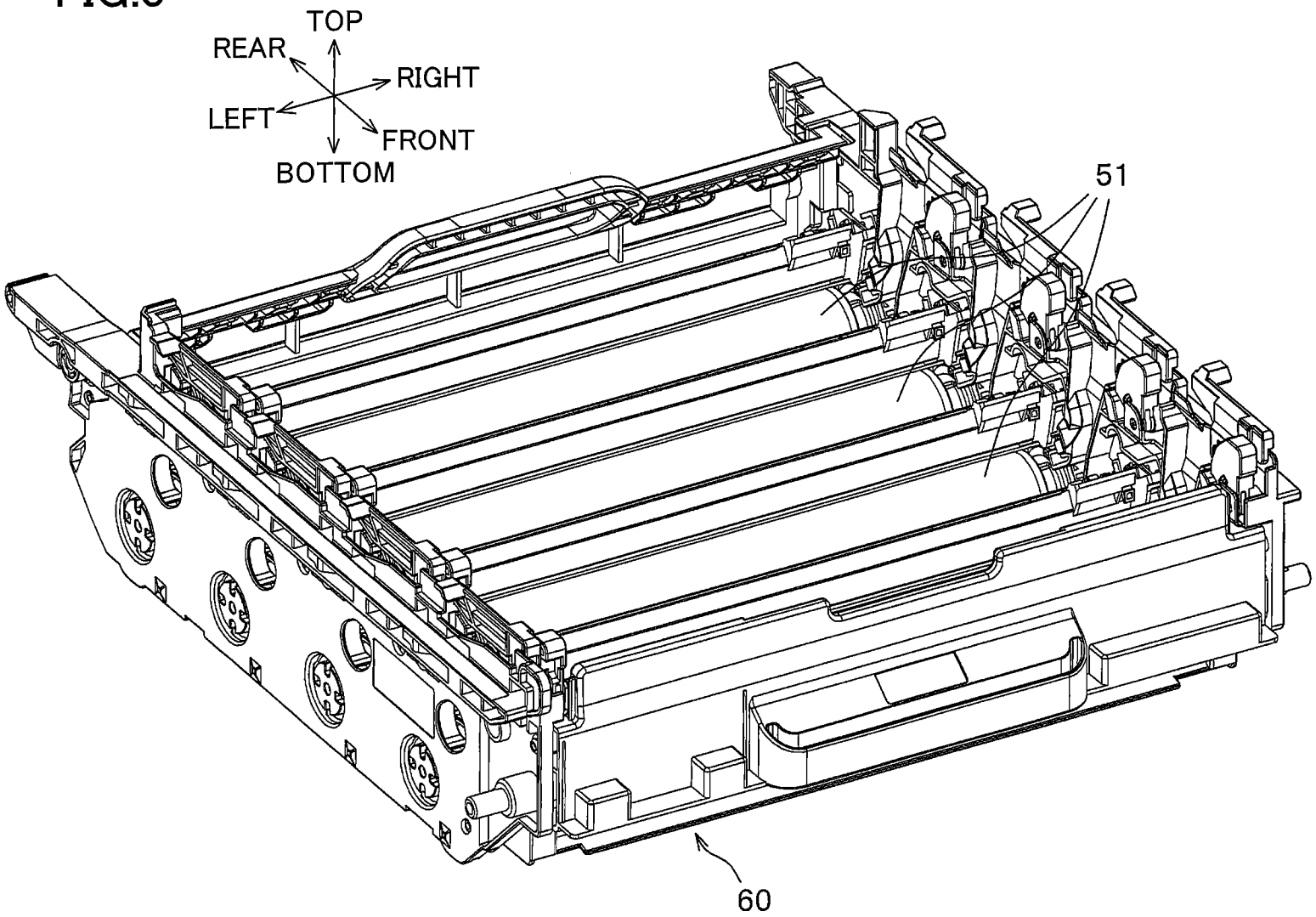
FIG. 3 is a perspective view of the photosensitive unit from which developing cartridges have been removed.

The photosensitive unit 50 is movable relative to the main frame 10 in a frontward/rearward direction through the opening 10A when the front cover 11 is opened. That is, the photosensitive unit 50 is mounted in and pulled out from to the main frame 10 in the rearward direction (prescribed direction) through the opening 10A. As also shown in FIGS. 2 and 3, the photosensitive unit 50 includes a drawer 60, four photosensitive drums 51 rotatably supported to the drawer 60, and four developer cartridges 52 detachably mounted in the drawer 60. Each of the developer cartridges 52 corresponds to each of the photosensitive drums 51.

The photosensitive drums 51 are juxtaposedly arrayed with each other in the frontward/rearward direction when the photosensitive unit 50 is mounted in the main frame 10. The drawer 60 is provided with well-known chargers (not shown). Each of the developer cartridges 52 includes a developing roller 53 for supplying toner (developing agent) to the corresponding photosensitive drum 51. The developing roller 53 is rotatably provided on the developer cartridge 52. The developer cartridge 52 further includes a well-known toner accommodating chamber and a well-known supply roller. A structure in and around the drawer 60 will be described later in detail.

The transfer unit 70 is disposed between the sheet supply unit 20 and the photosensitive unit 50. The transfer unit 70 includes a drive roller 71, a driven roller 72, a conveying belt 73, and transfer rollers 74.

The drive roller 71 and the driven roller 72 are disposed parallel to and are separated in the frontward/rearward direction. The conveying belt 73 as an endless belt is stretched around the drive roller 71 and the driven roller 72. The conveying belt 73 has an outer surface contacting each photosensitive drum 51. Inside the conveying belt 73, four transfer rollers 74 are disposed in confrontation with the four photosensitive drums 51, respectively, while pinching the conveying belt 73 with the four photosensitive drums 51. Transfer bias is applied to the transfer rollers 74 by constant current control when transferring a toner image on the sheet P.

The fixing unit 80 is disposed rearward of the photosensitive unit 50 and the transfer unit 70. The fixing unit 80 includes a heat roller 81 and a pressure roller 82. The pressure roller 82 is disposed in confrontation with the heat roller 81 to press the heat roller 81.

In the image forming unit 30 with the above-described configuration, the surface of each photosensitive drum 51 is exposed by the scanner unit 40 based on image data after uniformly charged by the charger. Hence, the electric potential of the surface exposed by the scanner unit 40 decreases, thereby forming an electrostatic latent image on the photosensitive drum 51. Then, the developing roller 53 supplies the toner accommodated in the developer cartridge 52 to the electrostatic latent image formed on the photosensitive drum 51. As a result, a visible toner image corresponding to the electrostatic latent image can be formed on the photosensitive drum 51.

Next, the toner images formed on the photosensitive drums 51 are transferred onto the sheet P while the sheet P conveyed to the conveying belt 73 passes between each photosensitive drum 51 and each transfer roller 74. Then, the toner images transferred onto the sheet P are thermally fixed on the sheet P while the sheet P passes between the heat roller 81 and the pressure roller 82.

The discharge unit 90 serves to discharge the sheet P on which an image has been formed. The discharge unit 90 includes a plurality of conveying rollers 91 for conveying the sheet P. The sheet P on which the toner image has been transferred and thermally fixed is conveyed by the conveying rollers 91 and discharged outside of the main frame 10.

<Structure In and Around Drawer 60>

Next, the structure in and around the drawer 60 will be described in detail.

Figure 4:
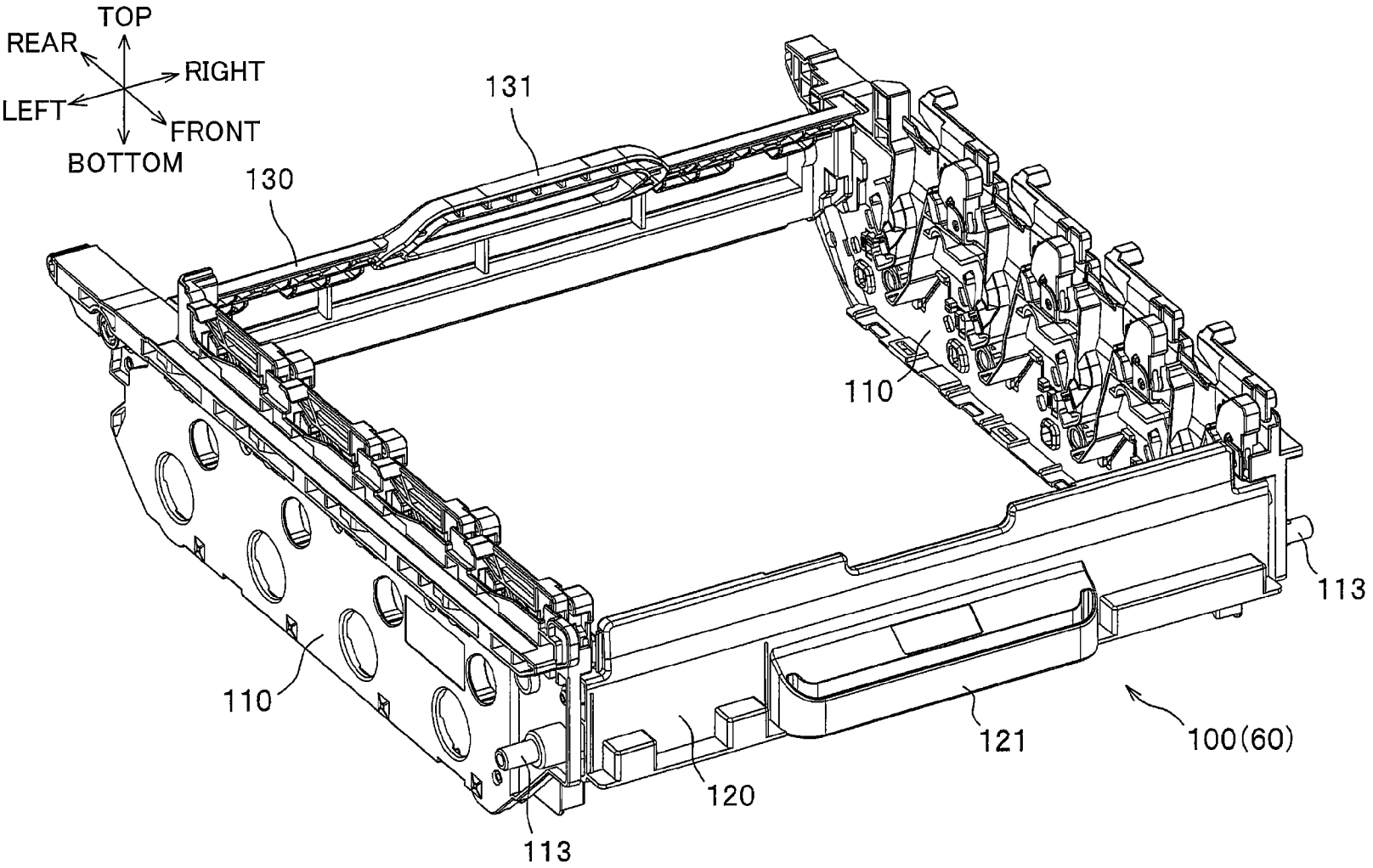
FIG. 4 is a perspective view of a resin frame according to the embodiment.
Figure 5:
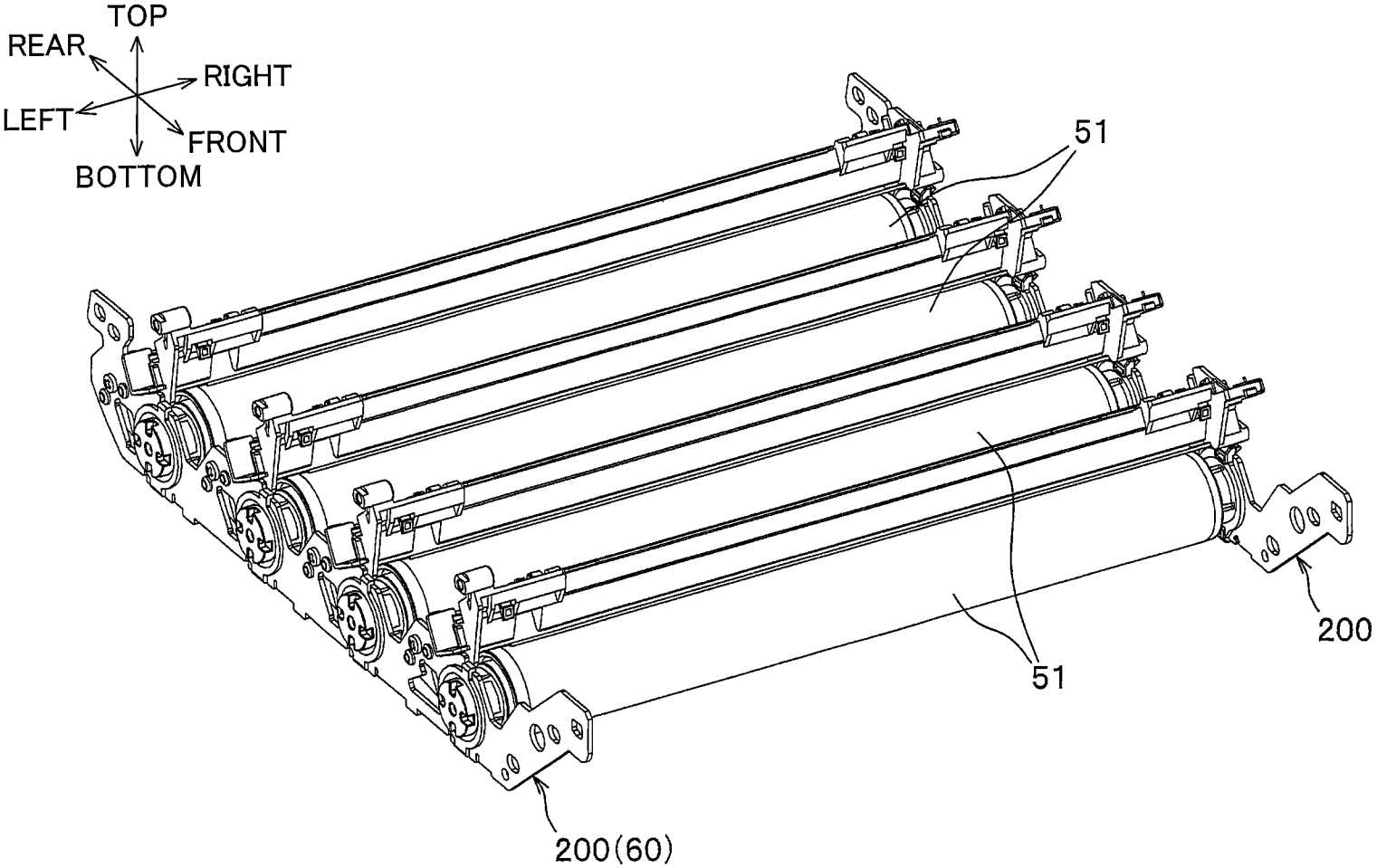
FIG. 5 is a perspective view of a pair of metal plates supporting a plurality of photosensitive drums according to the embodiment.

As shown in FIGS. 4 and 5, the drawer 60 includes a square shaped resin frame 100 and a pair of right and left metal plates 200 supported to the resin frame 100.

The resin frame 100 includes a pair of right and left side plates 110, a front beam 120, and a rear beam 130. Each end of the front beam 120 is connected to each of the pair of side plates 110 at a front portion thereof. The front beam 120 is provided with a first handle 121 that is held by a user. Each of the rear beam 130 is connected to each of the pair of side plates 110 at a rear portion thereof. The rear beam 130 is provided with a second handle 131 that is held by the user.

The pair of right and left metal plates 200 is arranged in confrontation with each other and spaced away from each other in an axial direction of the photosensitive drum 51 (a rightward/leftward direction), and rotatably supports the plurality of photosensitive drums 51. Further, in a state prior to positioning of the drawer 60 (the photosensitive unit 50) with respect to the main frame 10 (i.e. in a state that the drawer 60 is not mounted in the main frame 10), each metal plate 200 is supported to each side plate 110 at a lower portion thereof and movable in the frontward/rearward direction relative to the side plate 110. In other words, an assembly including the pair of metal plates 200 and the plurality of photosensitive drums 51 is movable relative to the resin frame 100 in the frontward/rearward direction.

Figure 6:
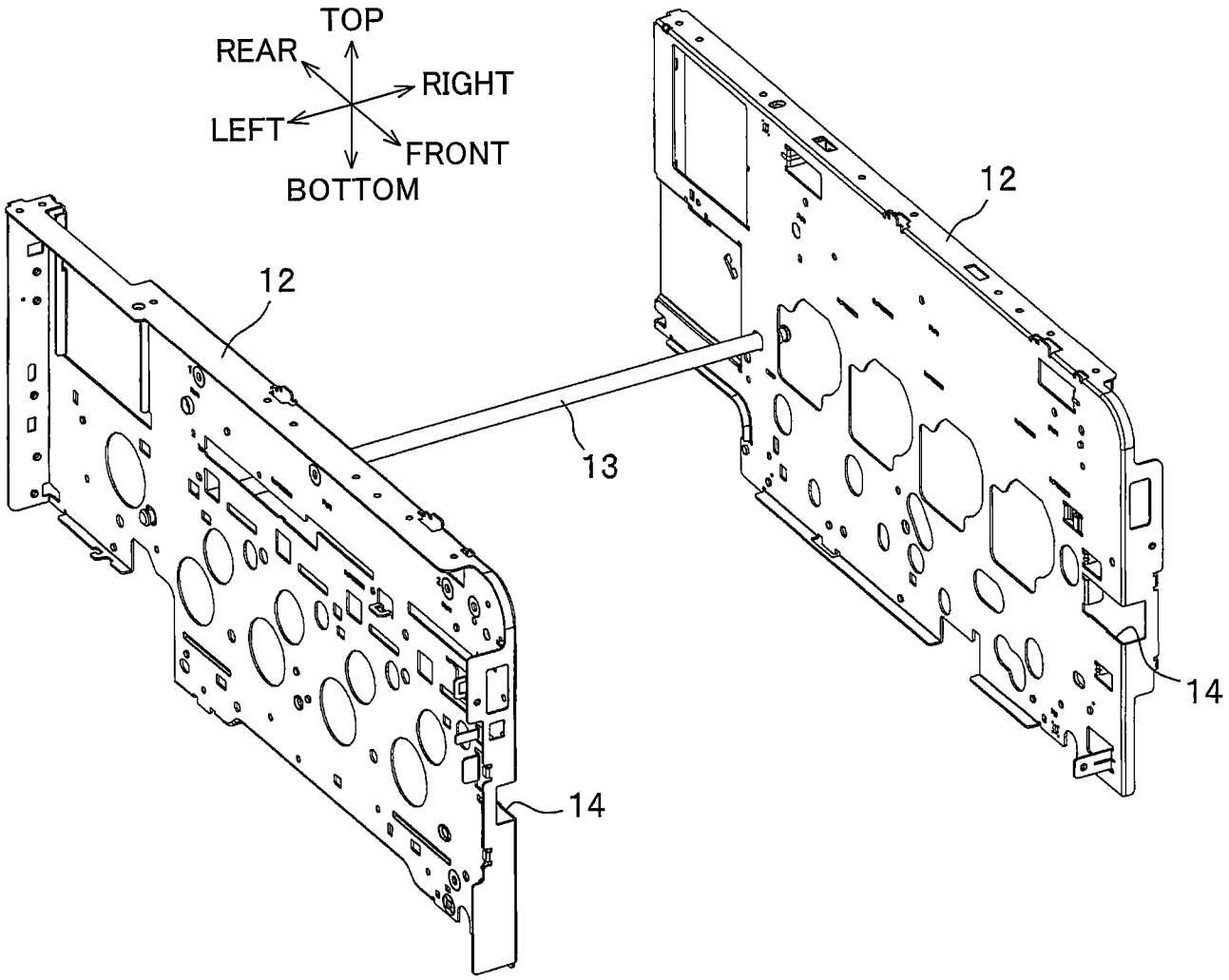
FIG. 6 is a perspective view of a pair of side plates and a positioning shaft according to the embodiment.
Figure 7:
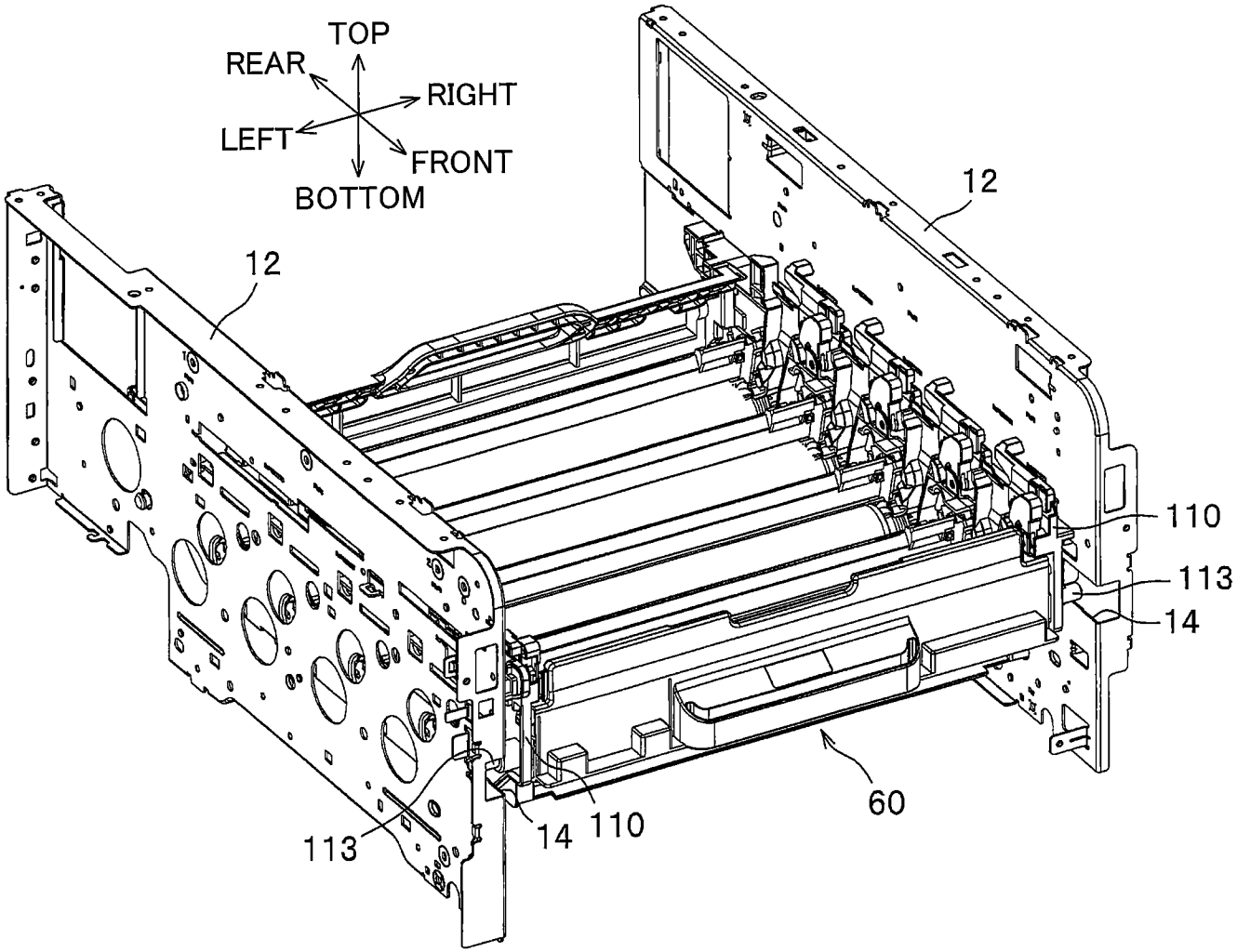
FIG. 7 is a perspective view of the pair of side plates on which the photosensitive unit is mounted.

Further, as shown in FIG. 6, within the main frame 10, a pair of right and left side plates 12 formed of metal and a positioning shaft 13 are provided. The positioning shaft 13 as a second positioning portion extends in the rightward/leftward direction and bridges between the pair of side plates 12 at a rear portion thereof. As shown in FIG. 7, each side plate 12 has a front edge in which a cutout portion 14 as a first positioning portion is formed. That is, the pair of cutout portions 14 is formed in the pair of side plates 12. The pair of cutout portions 14 is adapted to support a front portion of the drawer 60 (i.e. a pair of supported portions 113 described later).

When the drawer 60 is pressed below and rearward by a pressure unit 300 (shown in FIG. 8, described later), the drawer 60 is brought into abutment with the positioning shaft 13 and lower edges of the cutout portions 14, thereby positioning the drawer 60 with respect to the main frame 10.

Figure 9A:
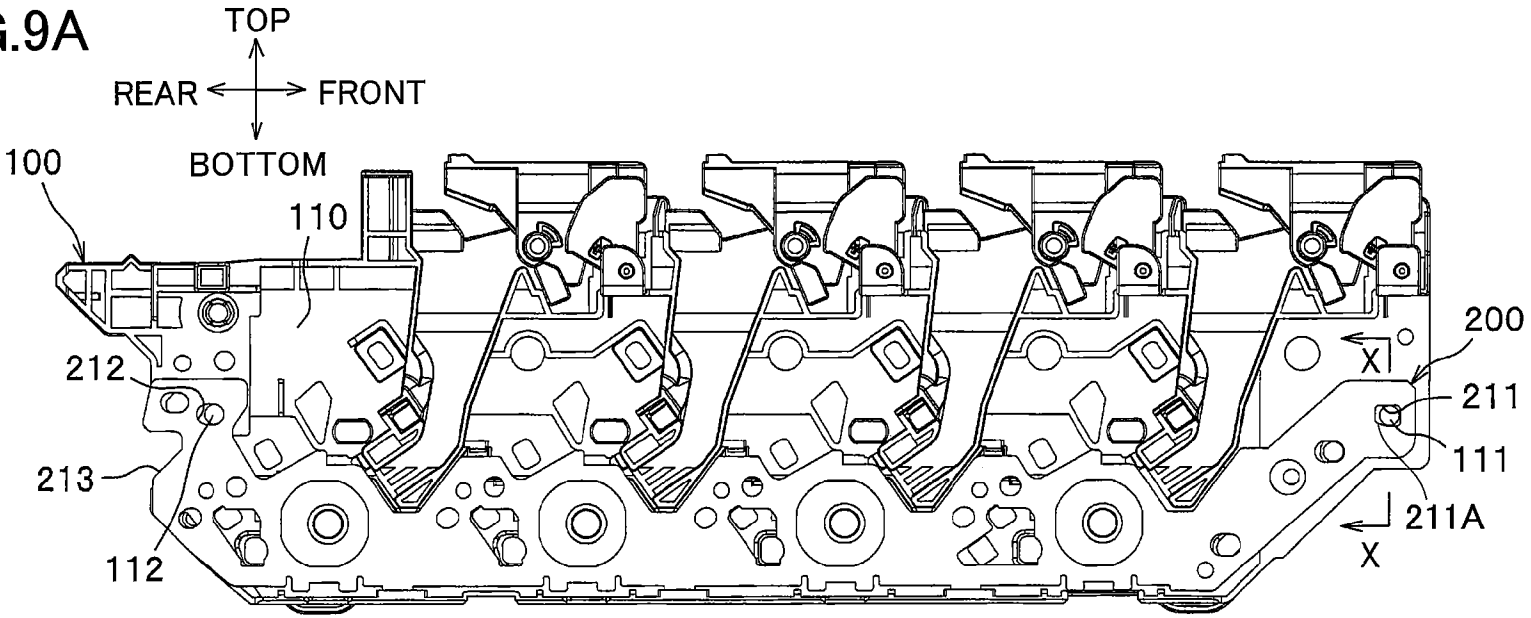
FIG. 9A is an inner side view of the resin frame and the metal plate before the photosensitive unit is mounted on a main frame of the color printer.
Figure 9B:
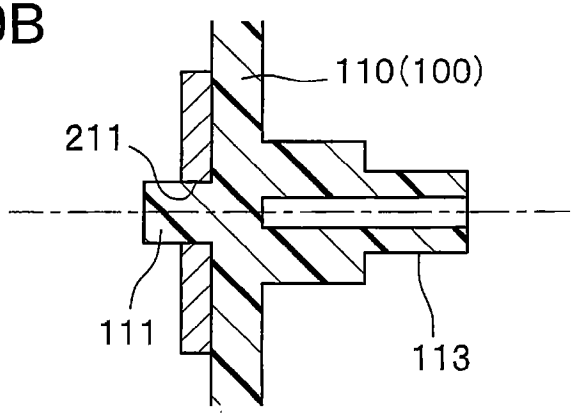
FIG. 9B is a cross-sectional view of the resin frame and the meal plate taken along a line X-X in FIG. 9A.
Figure 10:
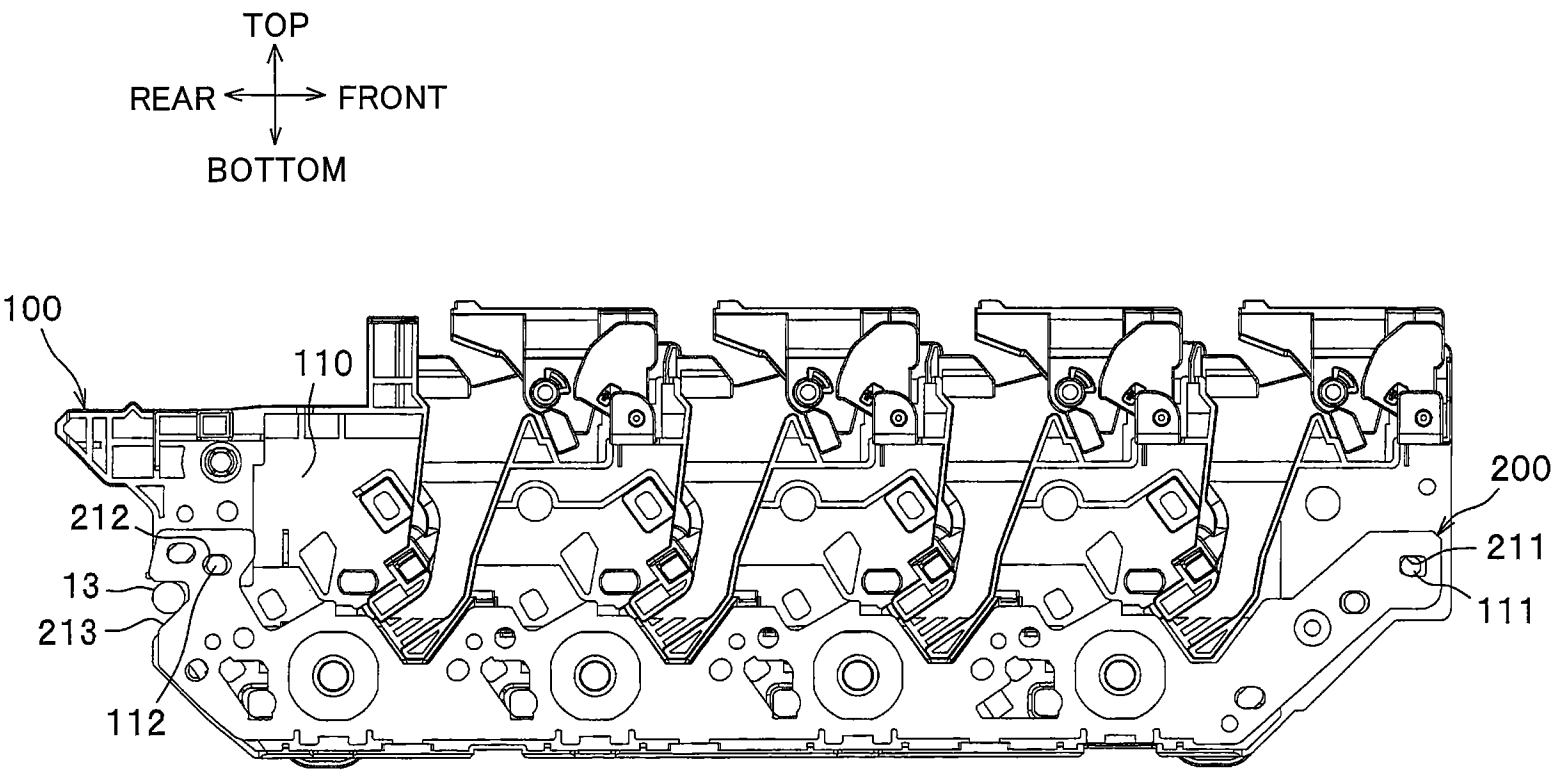
FIG. 10 is the inner side view of the resin frame and the metal plate after the photosensitive unit is mounted on the main frame and a front cover provided in the main frame is closed.

More specifically, as shown in FIGS. 9A, 9B, and 10, each side plate 110 of the resin frame 100 has a pressing protrusion 111, a supporting protrusion 112, and the supported portion 113 (see FIGS. 7 and 9B). The pressing protrusion 111 and the supporting protrusion 112 protrude inward from the side plate 110 in the rightward/leftward direction (toward a side at which the metal plates 200 are positioned). The supported portion 113 protrudes outward from the side plates 110 in the rightward/leftward direction (toward a side opposite to the side at which the metal plates 200 are positioned).

Further, each metal plate 200 is formed with a pressing hole 211 allowing the pressing protrusion 111 to penetrate therethrough, a supporting hole 212 allowing the supporting protrusion 112 to penetrate therethrough, and a positioning notch 213 abuttable with the positioning shaft 13 of the main frame 10.

The pressing hole 211 corresponds to a penetrating portion, a first engagement portion, and a first elongated hole. The supporting hole 212 corresponds to a third engagement portion and a second elongated hole. The positioning notch 213 corresponds to a second engagement portion.

The pressing protrusion 111 is disposed at the front portion of the side plate 110, while the pressing hole 211 is formed at a front portion of the metal plate 200. The pressing hole 211 is elongated in the frontward/rearward direction. The pressing hole 211 is engageable with the pressing protrusion 111 and movable relative to the pressing protrusion 111 in the frontward/rearward direction. In other words, the pressing protrusion 111 penetrates the pressing hole 211 such that the pressing protrusion 111 is movable relative to the pressing hole 211 in the frontward/rearward direction. The pressing hole 211 has a rear tapered section 211A that gradually narrows toward the rear side. The tapered section 211A as a downstream section serves to hold the pressing protrusion 111 with respect to the vertical direction.

With this configuration, as shown in FIG. 10, when the side plate 110 of the resin frame 100 is pushed rearward, a rear portion of the pressing protrusion 111 is brought into abutment with the tapered section 211A of the pressing hole 211 such that the pressing protrusion is engaged with the taper portion of the pressing hole 211. As a result, a pressure force from the pressing protrusion 111 is applied to the tapered section 211A of the pressing hole 211. Because the tapered section 211A of the pressing hole 211 holds the pressing protrusion 111 so as not to move the pressing protrusion 111 vertically, positioning of the front portion of the metal plate 200 and the side plate 110 in a vertical direction can be attained.

As shown in FIG. 7, each supported portion 113 is disposed at the front portion of the side plate 110. The supported portions 113 are supported to the corresponding cutout portions 14 formed in the side plates 12, so that the front portions of the side plates 110 are subjected to positioning in the vertical direction. With this configuration, as shown in FIG. 10, while the tapered sections 211A of the pressing holes 211 holds the corresponding pressing protrusions 111 of the side plates 110, the front portions of the metal plates 200 are supported by the side plates 12 (the main frame 10) via the side plates 110. Accordingly, the front portions of the metal plates 200 are subjected to positioning in the vertical direction. In other words, the positions of the front portions of the metal plates 200 with respect to the main frame 10 in the vertical direction are determined based on the engagement between the pressing protrusions 111 and the tapered sections 211A of the pressing holes 211 and the contact between the supported portions 113 and the cutout portions 14.

Further, as shown in FIG. 9, each of the pressing protrusion 111 and the supported portion 113 has a cylindrical configuration. Further, the pressing protrusion 111 and the supported portions 113 are coaxially positioned with each other. Because the pressing protrusion 111 and the supported portions 113 are coaxially positioned with each other, even if the resin frame 100 (side plate 110) is thermally expanded, a positional relationship between the pressing protrusion 111 and the supported portions 113 is rarely affected by the thermal expansion. Hence, positioning of the front portions of the metal plates 200 with respect to the main frame 10 can be accurately realized.

Each positioning notch 213 is formed so as to be depressed forward from a rear portion of the metal plate 200, while reducing its vertical length toward the front (i.e. each positioning notch 213 has a taper shape toward the front). With this configuration, as shown in FIG. 10, when the pressing protrusions 111 of the side plates 110 press the metal plates 200 rearward, the positioning notches 213 are brought into abutment with the positioning shaft 13, thereby restricting a further rearward movement as well as a vertical movement of the rear portions of the metal plates 200.

Each supporting hole 212 is formed in the rear portion of the side plate 110 and is elongated in the frontward/rearward direction. When the pressing protrusion 111 is in abutment with the tapered section 211A of the pressing hole 211, the supporting hole 212 is configured to form gaps (clearances) between the supporting hole 212 and the supporting protrusion 112 in the frontward/rearward direction. The gaps formed between the supporting hole 212 and the supporting protrusion 112 can absorb the thermal expansion of the resin frame 100.

Figure 8:
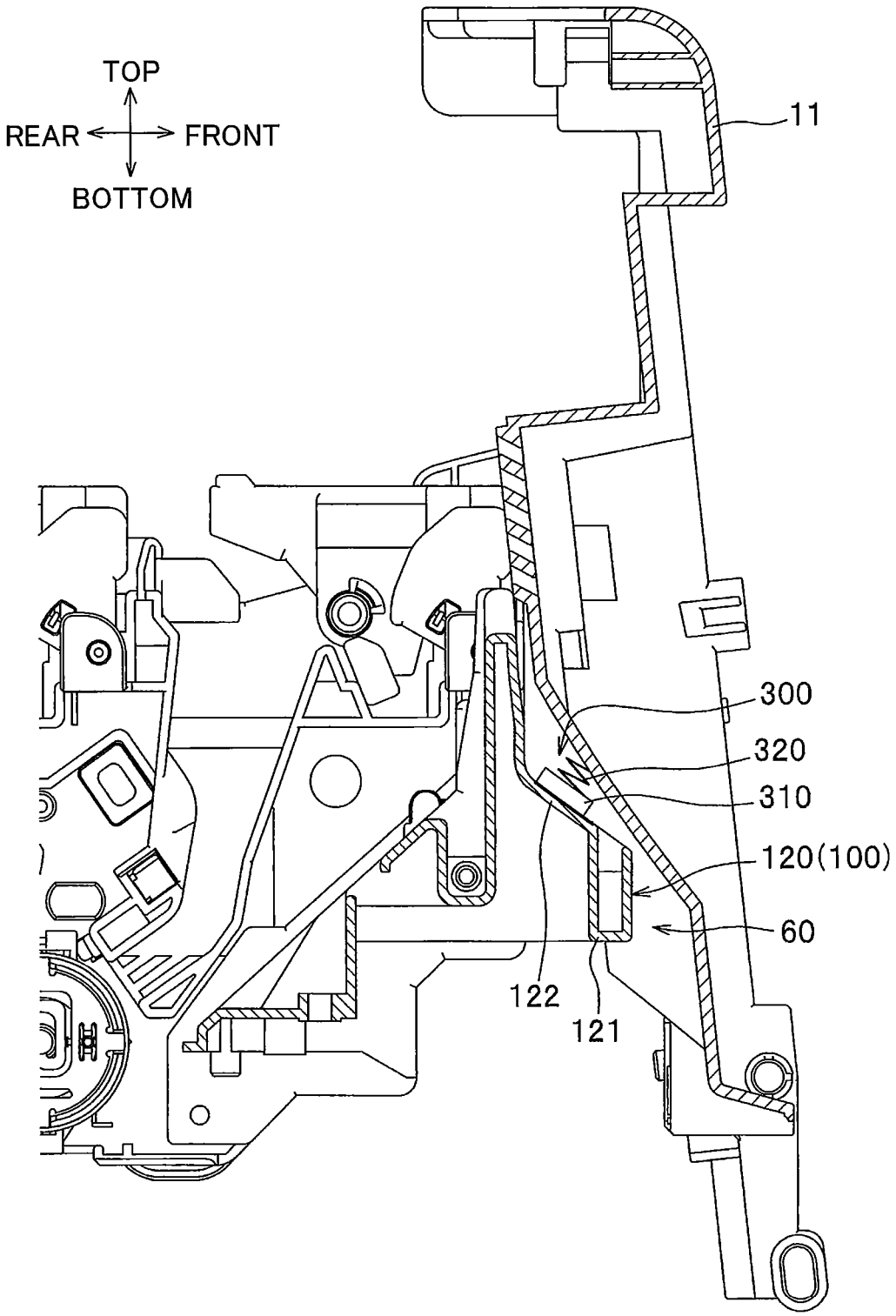
FIG. 8 is a cross-sectional view of a pressure member according to the embodiment.

As shown in FIG. 8, the first handle 121 provided at the front beam 120 of the resin frame 100 has a pressed portion 122 that is pressed by the pressure unit 300 provided at the front cover 11. The pressure unit 300 is adapted to press the metal plates 200 toward the positioning shaft 13 via the resin frame 100. The pressure unit 300 is positioned so as to contact the pressed portion 122 of the resin frame 100. More specifically, the pressure unit 300 includes a contact member 310 and a coil spring 320 as an urging member. The contact member 310 is provided so as to contact the pressed portion 122. The coil spring 320 is disposed between the contact member 310 and the front cover 11, and serves to urge the contact member 310 toward the pressed portion 122.

Next, a positioning method of the photosensitive unit 50 will be described.

When the user opens the front cover 11 to insert the photosensitive unit 50 into the main frame 10, the positioning notches 213 formed in the metal plates 200 are brought into abutment with the positioning shaft 13. At the same time, the supported portions 113 formed in the side plates 110 of the resin frame 100 are placed on the cutout portions 14 formed in the side plates 12.

When the user closes the front cover 11, the pressed portion 122 is pressed by the pressure unit 300 in a direction diagonally below and rearward. The supported portions 113 are therefore brought into abutment with the notched portions 14. As a result, positions of the supported portions 113 with respect to the main frame 10 in the vertical direction are determined reliably. Further, at this time, the resin frame 100 is moved rearward relative to the metal plates 200, and thus, the pressing protrusions 111 are brought into abutment with the tapered sections 211A of the pressing holes 211. As a result, the positions of the front portions of the metal plates 200 with respect to the resin frame 100 in the vertical direction are determined. More specifically, the front portions of the metal plates 200 are positioned in the vertical direction with respect to the front portion of the resin frame 100 that is positioned by the cutout portions 14 formed in the side plates 12 of the main frame 10. Further, the pressing protrusions 111 press the metal plates 200 rearward via the pressing holes 211, so that the positioning notches 213 are reliably pressed against the positioning shaft 13. As a result, the metal plates 200 supporting the plurality of the photosensitive drums 51 are reliably positioned with respect to the main frame 10 in the vertical direction as well as in the frontward/rearward direction.

According to the above-described embodiment, the following effects can be obtained.

Compared with a conventional configuration in which metal plates are pressed via a shaft separately from a resin frame, the number of parts and components can be reduced because the pressure unit 300 presses the metal plates 200 against the positioning shaft 13 via the resin frame 100.

The resin frame 100 is configured to movably support the metal plates 200 in the frontward/rearward direction before positioning of the photosensitive unit 50 in the main frame 10 is completed. With this configuration, no distortion due to thermal expansion occurs in the resin frame 100. Accordingly, regardless of thermal expansion, the position of the photosensitive unit 50 with respect to the main frame 10 can be determined precisely.

When the resin frame 100 is pressed by the pressure unit 300, the pressing protrusions 111 are brought into abutment with the tapered sections 211A of the pressing holes 211 to be held by the pressing holes 211. Accordingly, the metal plates 200 can be accurately positioned in the vertical direction with respect to the resin frame 100 that is supported to the main frame 10.

The pressing hole 211 is formed in the front portion of the metal plate 200 and apart from the positioning notch 213 formed in the rear portion of the metal plate 200. Accordingly, the metal plate 200 is subjected to positioning in the vertical direction at the rear and front portions thereof. Hence, the positions of the metal plates 200 with respect to the resin frame 100 can be determined more accurately.

The pressing protrusion 111 and the supported portion 113 have cylindrical configurations and are coaxially positioned with each other. Even if the resin frame 100 is thermally expanded, the positional relationship between the pressing protrusion 111 and the supported portion 113 can be maintained. Accordingly, positioning of the metal plates 200 with respect to the main frame 10 can be precisely attained.

When the pressing protrusion 111 penetrates through the pressing hole 211, the gaps are formed between the supporting hole 212 and the supporting protrusion 112. Accordingly, the thermal expansion of the resin frame 100 can be absorbed by the gaps formed between the supporting hole 212 and the supporting protrusion 112.

While the invention has been described in detail with reference to the embodiment thereof, it would be apparent to those skilled in the art that various changes and modifications may be made therein without departing from the spirit of the invention. Modifications of the embodiment will be described while referring to the accompanying drawings wherein like parts and components are designated by the same reference numerals to avoid duplicating description.

Figure 11:
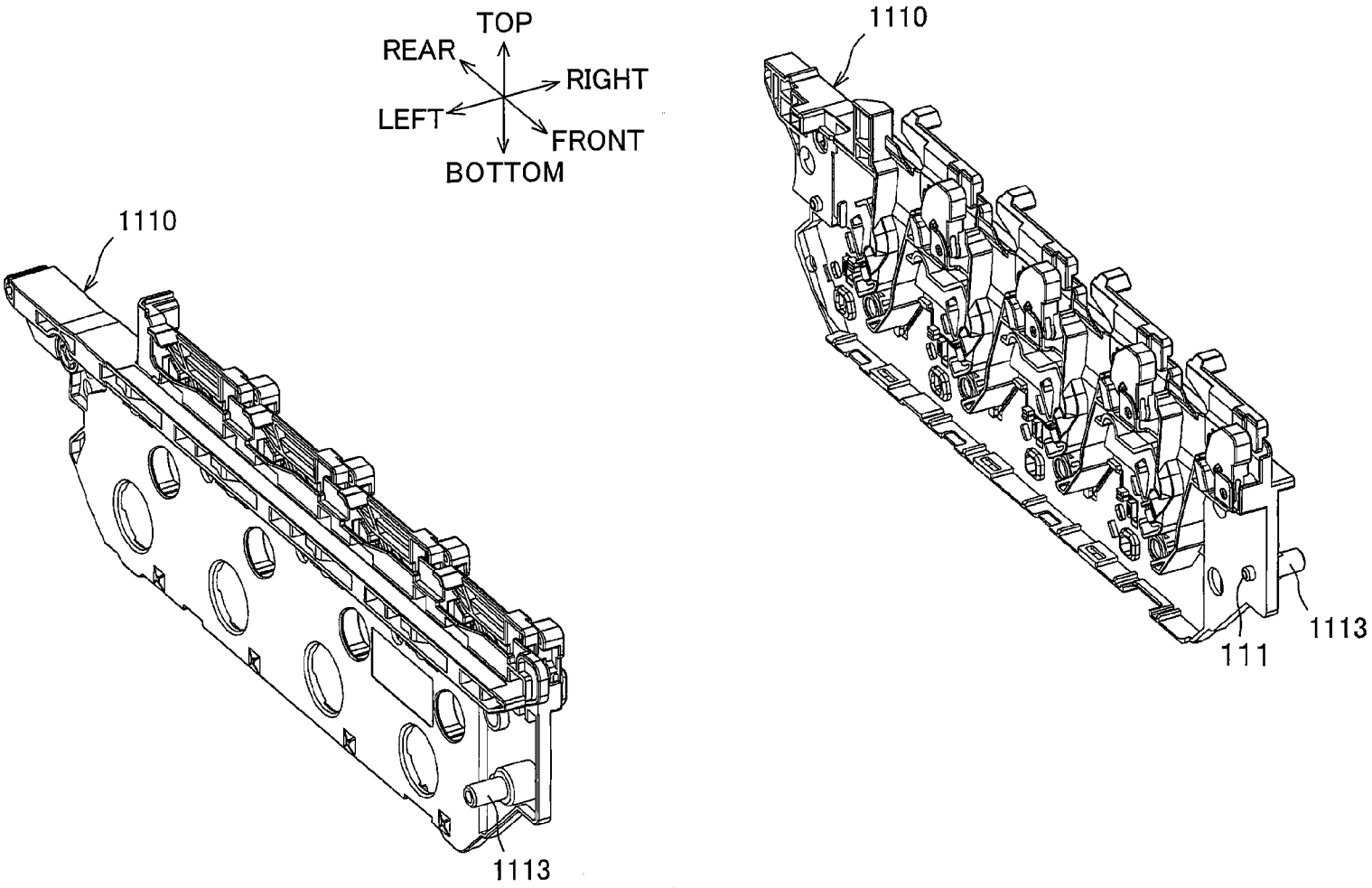
FIG. 11 is a perspective view of a pair of resin frames according to a first modification of the present invention.
Figure 12:
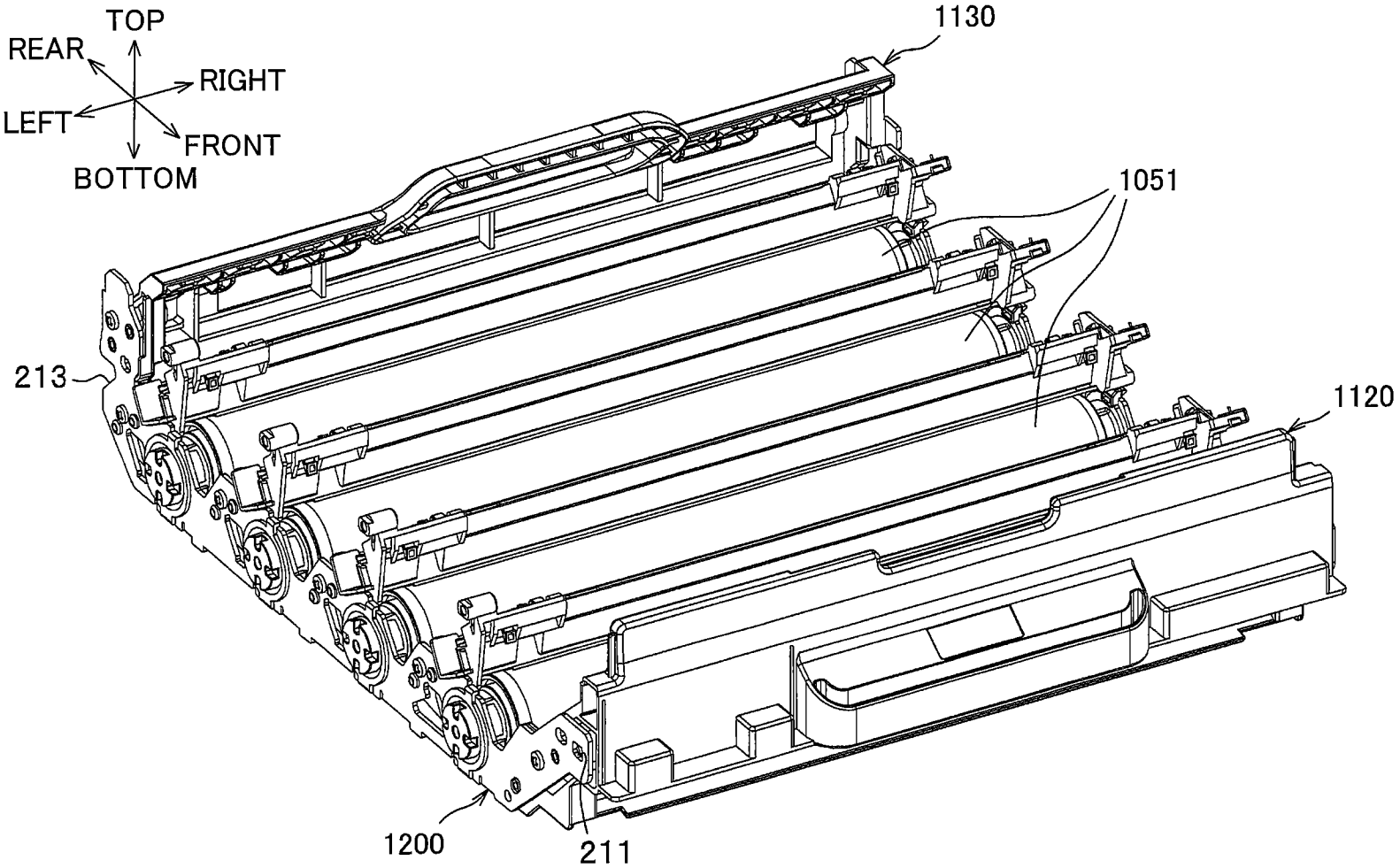
FIG. 12 is a perspective view of an assembly movable in a frontward/rearward direction relative to the pair of resin frames shown in FIG. 11.

A first modification will be described while referring to FIGS. 11 to 14. In the above-described embodiment, the pair of metal plates 200 (more specifically, the assembly including the pair of metal plates 200 and the plurality of photosensitive drums 51) is movable in the frontward/rearward direction relative to the resin frame 100 formed in a square shape. However, as long as a pair of metal plates is supported to a pair of resin frames and movable relative to the pair of resin frames in the frontward/rearward direction, any structure for the resin frames and the metal plates is available to the present invention. For example, as shown in FIGS. 11 and 12, a pair of metal plates 1200, a plurality of photosensitive drums 1051, a front beam 1120, and a rear beam 1130 may constitute an integral unit. The integral unit is movable relative to a pair of right and left side frames 1110 made of resin.

Figure 13:
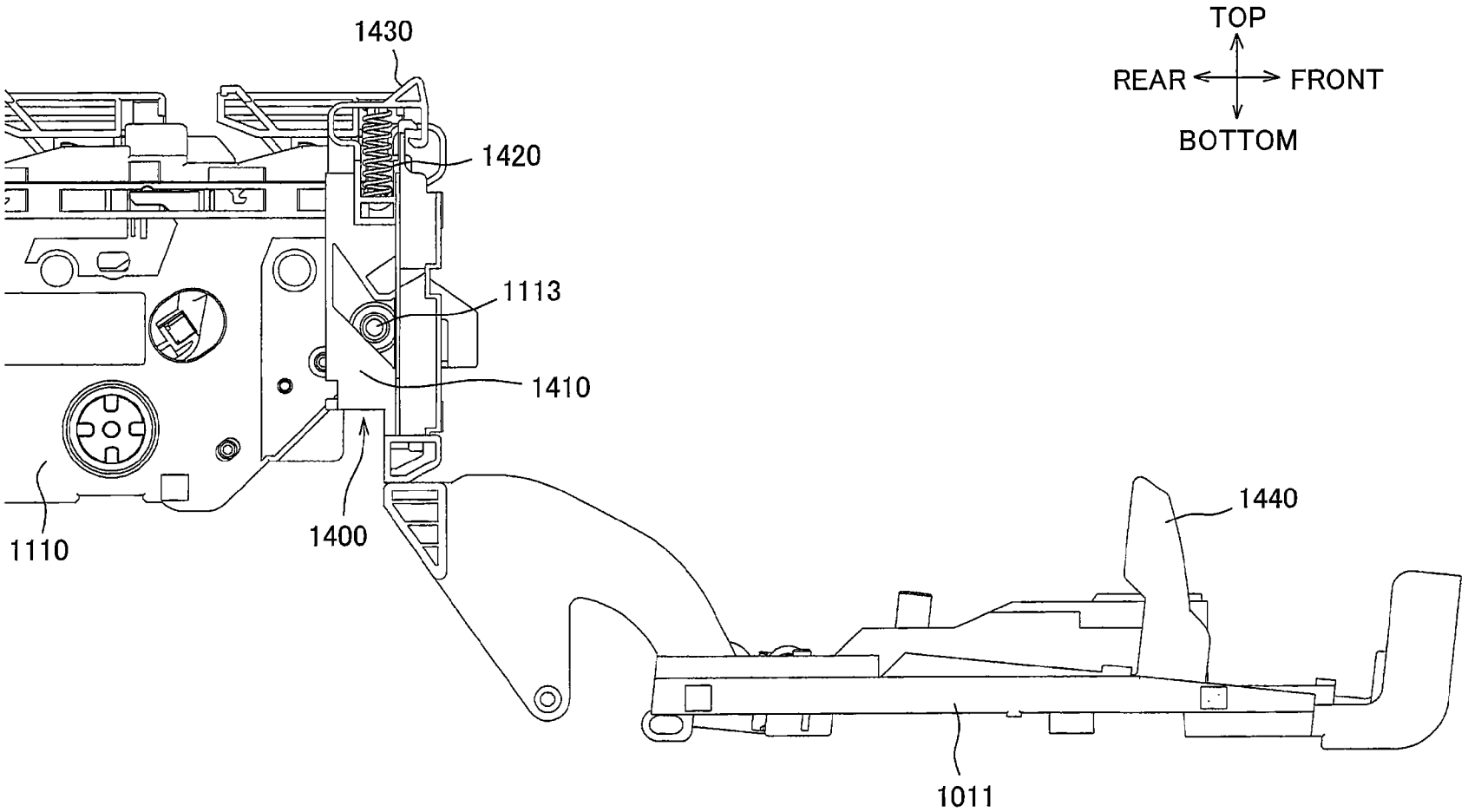
FIG. 13 is a left side view of a pressure member according to the first modification of the present invention, wherein a front cover is opened.
Figure 14:
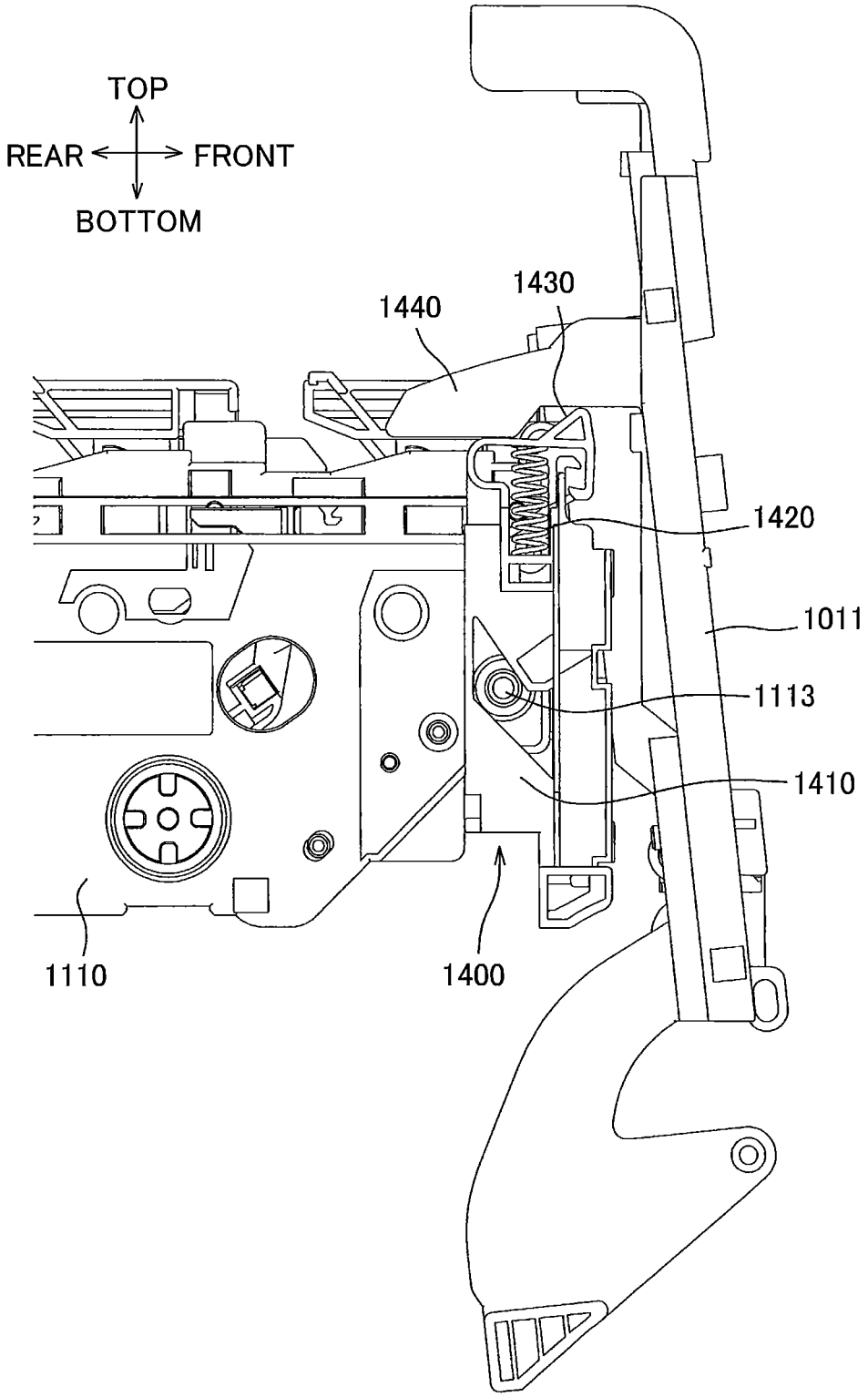
FIG. 14 is the left side view of the pressure member according to the first modification of the present invention, wherein the front cover is closed.

Further, in the above-described embodiment, the supported portions 113 and the pressed portion 122 are separately provided. However, as shown in FIGS. 13 and 14, each supported portion 1113 may function as a pressed portion. Each supported portion 1113 is pressed by a pressure unit 1400 provided in the main frame 10. With this configuration, each pressure unit 1400 presses the supported portion 1113 against the main frame 10, thereby accurately positioning the supported portions 1113 in the vertical direction.

Each pressure unit 1400 includes a linearly movable cam 1410, a coil spring 1420, an engaged member 1430, and an engaging member 1440. The cam 1410 is supported to the main frame 10 and is movable in the vertical direction relative to the main frame 10. The engaged member 1430 is integrally fixed to the cam 1410 and defines a space for retaining the coil spring 1420 therein. The engaging member 1440 is provided on the front cover 1011. When the front cover 1011 is closed, the engaging member 1440 is brought into engagement with an upper portion of the engaged member 1430. Upon engagement of the engaging member 1440 with the upper portion of the engaged member 1430, the upper portion of the engaged member 1430 is resiliently deformed so as to bend downward. As a result, the coil spring 1420 retained in the engaged member 1430 is compressed, and the cam 1410 is moved downward. Hence, the supported portions 1113 of the side plates 1110 are pressed rearward and downward by the biasing force of the coil spring 1420.

Figure 15:
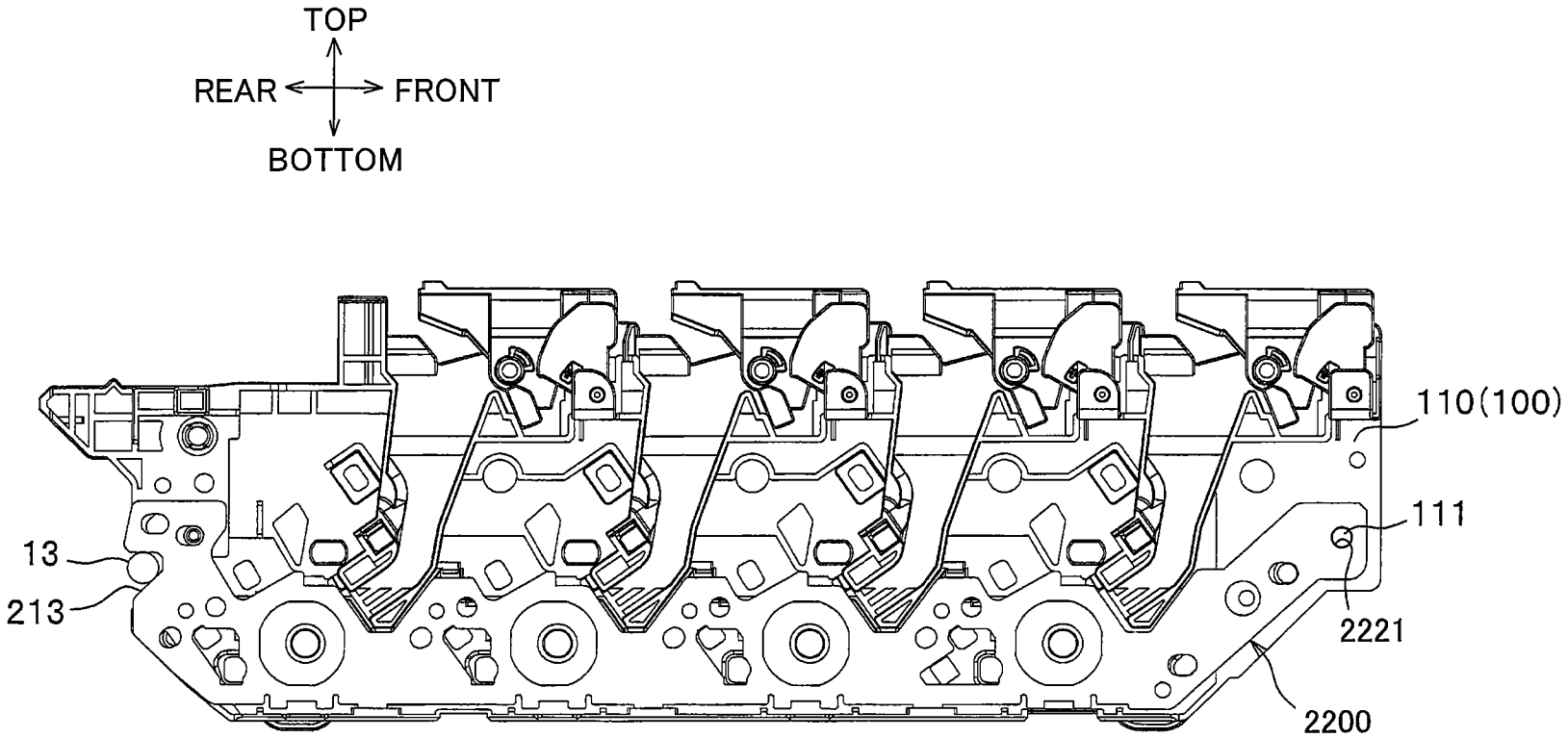
FIG. 15 is an inner side view of a resin frame and a metal plate, the metal plate being formed with a pressing hole according to a second modification of the present invention.

A second modification will be described while referring to FIG. 15. In the above-described embodiment, the elongated pressing hole 211 is formed in each metal plate 200. However, as shown in FIG. 15, the metal plate 2200 is formed with a through-hole 2221 into which the pressing protrusion 111 is fit. That is, the metal plate 2200 has a diameter that is substantially equal to a diameter of the pressing protrusion 111. Even in this case, each metal plate 2200 can be accurately positioned in the vertical direction with respect to the side plate 110 of the resin frame 100 that is supported to the main frame 10. The through-hole 2221 may be a circular-shaped hole when the pressing protrusion 111 has a cylindrical shape as described in the above embodiment. Alternatively, the through-hole 2221 may be a polygonally-shaped hole when a pressing protrusion is a polygonal column.

Further, in the above-described embodiment, the photosensitive unit 50 is movable relative to the main frame 10 in the frontward/rearward direction. However, the photosensitive unit 50 may be movable relative to the main frame 10 in the rightward/leftward direction. In this case, the position of the photosensitive unit 50 with respect to the main frame 10 in the rightward/leftward direction is determined.

Further, the pressing hole 211 and the supporting hole 212 may be replaced with cutout portions or ribbed portions.

Further, the above-described embodiment pertains to the color printer 1. However, other kinds of image forming apparatus such as a copying machine and a multifunction device are also available.

What is claimed is:

1. An image forming apparatus comprising:

a main frame having an opening, the main frame including a cover and a positioning portion, the cover being configured to move between a closed position covering the opening and an open position exposing the opening;

a drawer configured to be moved relative to the main frame in a prescribed direction;

a plurality of cartridges configured to be detached from and mounted in the drawer;

a contact member configured to contact the drawer in response to the movement of the cover to the closed position; and an urging member disposed between the cover and the contact member, the urging member being configured to urge the contact member toward the drawer in response to the movement of the cover to the closed position such that the drawer is pressed against the positioning portion.

2. The image forming apparatus according to claim 1, wherein the drawer includes a pair of side plates and a beam configured to connect the pair of side plates, and wherein the contact member is configured to contact the beam.

3. The image forming apparatus according to claim 2, wherein the beam includes a handle, and wherein the contact member is configured to contact the handle.

4. The image forming apparatus according to claim 1, wherein the drawer includes a pair of side plates and a plurality of photosensitive drums configured to be rotatably supported to the pair of side plates.

5. The image forming apparatus according to claim 4, wherein the pair of side plates is made of metal.

6. The image forming apparatus according to claim 5, wherein the drawer includes a pair of resin frames configured to support the pair of side plates, respectively.

7. The image forming apparatus according to claim 4, wherein the plurality of cartridges is provided in one-to-one correspondence with the plurality of photosensitive drums, the plurality of cartridges each including a developing roller configured to supply developer to the corresponding photosensitive drum.

8. The image forming apparatus according to claim 1, wherein the drawer is configured to support the plurality of cartridges such that the plurality of cartridges is juxtaposed with each other in the prescribed direction.

9. The image forming apparatus according to claim 1, wherein the urging member comprises a coil spring.

* * * * *